US007921801B2

(12) United States Patent
Ishihara et al.

(10) Patent No.: US 7,921,801 B2
(45) Date of Patent: Apr. 12, 2011

(54) DROPLET JETTING APPLICATOR AND METHOD FOR MANUFACTURING COATED BODY

(75) Inventors: Haruhiko Ishihara, Yokohama (JP); Atsushi Kinase, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1233 days.

(21) Appl. No.: 11/535,291

(22) Filed: Sep. 26, 2006

(65) Prior Publication Data

US 2007/0224351 A1 Sep. 27, 2007

(30) Foreign Application Priority Data

Mar. 22, 2006 (JP) ..... 2006-079377

(51) Int. Cl.
*B05C 11/00* (2006.01)
*B05C 13/02* (2006.01)

(52) U.S. Cl. ..... 118/692; 118/684; 118/663; 118/58; 118/64

(58) Field of Classification Search ..... 118/50, 118/634, 326, 663, 313–315, 692, 58, 61–64, 118/695, 684, 699, 702, 703, 704; 347/84, 347/85, 19; 427/8, 58, 96.1, 96.2, 294, 421.1, 256, 466
See application file for complete search history.

(56) References Cited

U.S. PATENT DOCUMENTS

| | | | | |
|---|---|---|---|---|
| 6,473,995 | B2 | 11/2002 | Miyakawa et al. | |
| 7,343,695 | B2 | 3/2008 | Miyakawa et al. | |
| 2004/0056915 | A1 * | 3/2004 | Miyazawa | 347/19 |
| 2005/0095356 | A1 * | 5/2005 | Nakamura et al. | 427/58 |

FOREIGN PATENT DOCUMENTS

| | | |
|---|---|---|
| JP | 2001-235277 | 8/2001 |
| JP | 2003-234273 | 8/2003 |
| KR | 1996-0008896 | 7/1996 |
| KR | 2002-0050006 | 6/2002 |
| KR | 10-0798376 | 1/2008 |

* cited by examiner

*Primary Examiner* — Yewebdar T Tadesse
(74) *Attorney, Agent, or Firm* — Oblon, Spivak, McClelland, Maier & Neustadt, L.L.P.

(57) ABSTRACT

A droplet jetting applicator includes a coating unit jetting and coating droplets to a to-be-coated object; a storage space storing the to-be-coated object coated with the droplets; an exhaust section exhausting gas in the storage space; an adjustment unit adjusting an outlet flow of the gas exhausted by the exhaust section from the storage space; and a control section controlling the adjustment unit so that the outlet flow is changed in a stepwise manner.

4 Claims, 6 Drawing Sheets

DROPLET JETTING APPLICATOR AND METHOD FOR MANUFACTURING COATED BODY

CROSS REFERENCE OF THE RELATED APPLICATION

This application is based upon and claims the benefit of priority from the prior Japanese Patent Application No. 2006-79377, filed on Mar. 22, 2006; the entire contents of which are incorporated herein by reference.

BACKGROUND OF THE INVENTION

1. Field of the Invention

The present invention relates to a droplet jetting applicator that jets droplets to a to-be-coated object to coat the object and a method for manufacturing a coated body.

2. Discussion of the Background

A droplet jetting applicator has been generally used to manufacture various display apparatuses such as a liquid crystal display apparatus, an organic Electro Luminescence (EL) display apparatus, an electron emission display apparatus, a plasma display apparatus, and an electrophoresis display apparatus.

A droplet jetting applicator includes: a droplet jetting head having a plurality of nozzles for jetting droplets (e.g., ink droplets) to a to-be-coated object, respectively (e.g., ink jet head); and a drying unit for drying droplets adhered to the to-be-coated object, for example. This droplet jetting applicator uses the droplet jetting head to adhere droplets on a to-be-coated object to form a dot column having a predetermined pattern to dry the droplets on the to-be-coated object, thereby manufacturing a coated body such as a color filter or a black matrix (frame of the color filter) for example.

With regards to the droplet jetting applicator as described above, such a droplet jetting applicator has been suggested that dries, while a to-be-coated object being dried, ink by a vacuum drying (see JP-A No. 2001-235277(KOKAI) and JP-A No. 2003-234273(KOKAI) for example). This droplet jetting applicator has a drying unit that includes, for example, an exhaust section that exhausts gas in a storage space for storing a to-be-coated object coated with droplets (e.g., vacuum chamber) to vacuumize the storage space.

However, ink dried by the vacuum drying with a high speed causes airflow in the storage space that dries the ink surface on the to-be-coated object. This causes, before gas generated from the ink (e.g., solvent, moisture, dissolved gas) is completely removed, formation of a thin film on the ink surface (i.e., surface layer film). When gas is generated from the ink while such a surface layer film being left on the ink surface, the gas causes an explosion of the surface layer film at the ink surface to cause ink to flow from the exploded part. This causes ink to fly or to be extruded, causing a defectively-manufactured coated body.

SUMMARY OF THE INVENTION

It is an objective of the present invention to provide a droplet jetting applicator that can prevent a defectively-manufactured coated body due to an explosion of the surface layer film of droplets adhered to the coated object, and a method for manufacturing a coated body.

According to a first aspect of embodiments of the invention, there is provided a droplet jetting applicator, which includes a coating unit jetting and coating droplets to a to-be-coated object; a storage space storing the to-be-coated object coated with the droplets; an exhaust section exhausting gas in the storage space; an adjustment unit adjusting an outlet flow of the gas exhausted by the exhaust section from the storage space; and a control section controlling the adjustment unit so that the outlet flow is changed in a stepwise manner.

In accordance with a second aspect of embodiments of the invention, there is provided a droplet jetting applicator, which includes a coating unit jetting and coating droplets to a to-be-coated object; a storage space that includes a dispersion plate provided to have a distance from a storage position at which the to-be-coated object coated with the droplets is stored and has a plurality of penetration holes and that includes a blocking plate provided between the storage position and the dispersion plate so as to be able to have a contact with or be away from the storage position, the storage space stores the to-be-coated object coated with the droplets at the storage position; and an exhaust section exhausting gas in the storage space. The storage space has an opening section provided at a surface consisting of a side surface closer to a top surface than the surface of the dispersion plate and the top surface, and the exhaust section exhausts gas in the storage space through the opening section.

According to a third aspect of embodiments of the invention, there is provided a method for manufacturing a coated body, which includes: jetting and coating droplets to a to-be-coated object; storing the to-be-coated object coated with the droplets in a storage space; exhausting gas in the storage space; and changing an outlet flow of the gas exhausted from the storage space in a stepwise manner.

In accordance with a forth aspect of embodiments of the invention, there is provided a method for manufacturing a coated body, which includes: jetting and coating droplets to a to-be-coated object; storing, in a storage space that includes a dispersion plate provided to have a distance from a storage position at which the to-be-coated object coated with the droplets is stored and has a plurality of penetration holes and that includes a blocking plate provided between the storage position and the dispersion plate so as to be able to have a contact with or be away from the storage position, the to-be-coated object coated with the droplets at the storage position so that the stored to-be-coated object is close to the blocking plate; and exhausting gas in the storage space through an opening section provided at a surface consisting of a side surface closer to a top surface than the surface of the dispersion plate and the top surface.

DETAILED DESCRIPTION OF THE INVENTION

Embodiment 1

Hereinafter, Embodiment 1 will be described with reference to FIG. 1 to FIG. 6.

Figure 1:
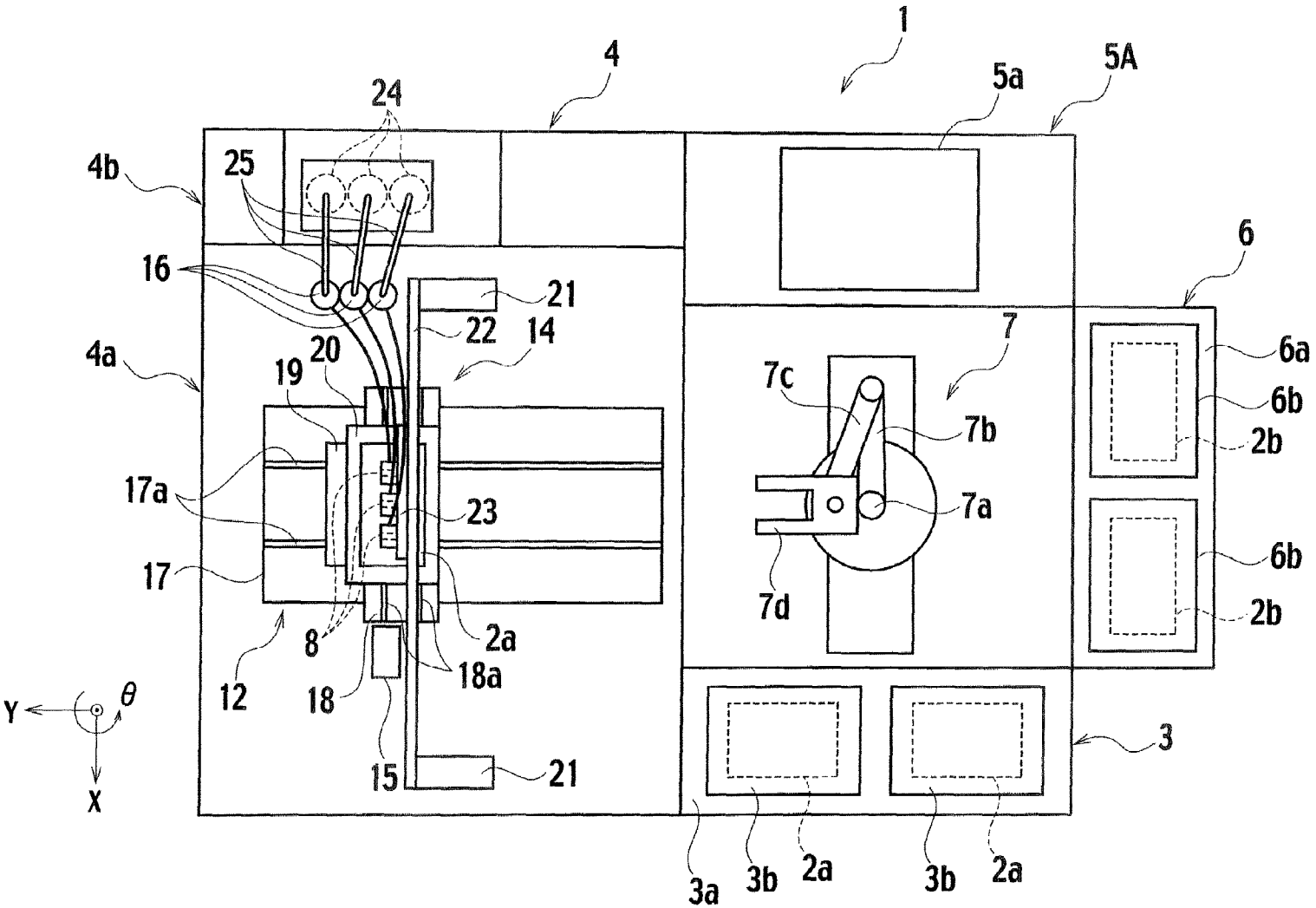
FIG. 1 is a top view illustrating a schematic structure of a droplet jetting applicator according to Embodiment 1 of the present invention.

As shown in FIG. 1, a droplet jetting applicator 1 according to Embodiment 1 includes: a substrate storage section 3 for storing a substrate 2*a* as a to-be-coated object; a coating unit 4 for jetting droplets to the substrate 2*a* to coat substrate 2*a*; a drying unit 5A for drying the coated substrate 2*a*; a coated body storage section 6 for storing a coated body 2*b* as the dried substrate 2*a*; and a transport unit 7 for transporting the substrate 2*a* through these substrate storage section 3, coating unit 4, drying unit 5A, and coated body storage section 6.

The substrate storage section 3 has: a counter 3*a*; and a storage rack 3*b* that is detachably attached on the counter 3*a*. The storage rack 3*b* stores therein a plurality of substrates 2*a*. These substrates 2*a* are transported by the transport unit 7 to the coating unit 4, respectively.

The coating unit 4 has: an ink coating box 4*a* for coating liquid-form ink to the substrate 2*a* so that the ink in the form of droplets are coated on the substrate 2*a*; and an ink supply box 4*b* for supplying ink to the ink coating box 4*a*. The ink coating box 4*a* includes a plurality of droplet jetting heads 8 for jetting droplets. This coating unit 4 uses the respective droplet jetting heads 8 to jet ink as droplets (ink droplets) so that the surface of the substrate 2*a* is coated, for example, with a frame pattern of a color filter. The coated substrate 2*a* is transported by the transport unit 7 from the coating unit 4 to the drying unit 5A.

The drying unit 5A has, for example, a storage space 5*a* such as a vacuum chamber for storing the coated substrate 2*a*. This drying unit 5A exhausts gas in the storage space 5*a* to vacuumize the storage space 5*a* to dry the droplets on the coated substrate 2*a* stored in the storage space 5*a*.

The coated body storage section 6 has a counter 6*a* and a storage rack 6*b* detachably attached on the counter 6*a*. This storage rack 6*b* stores therein the coated body 2*b* that is the dried substrate 2*a* transported from the transport unit 7.

The transport unit 7 has: an up-and-down axis 7*a* that can be moved in an up-and-down direction; links 7*b* and 7*c* that are connected to an upper end section of the up-and-down axis 7*a* so as to rotatable in a horizontal surface (X-Y plain surface); and an arm 7*d* attached to tip ends of the links 7*b* and 7*c*. This transport unit 7 moves up and down the up-and-down axis 7*a* and rotates the links 7*b* and 7*c*, takes the substrate 2*a* out of the storage rack 3*b* of the substrate storage section 3 to transport the substrate 2*a* to the coating unit 4, transports the coated substrate 2*a* from the coating unit 4 to the drying unit 5A to place the coated substrate 2*a* in the drying unit 5A, and takes the coated body 2*b* as the dried substrate 2*a* out of the drying unit 5A to transport the coated body 2*b* to the coated body storage section 6 to place the coated body 2*b* in the storage rack 6*b*.

Next, the coating unit 4 will be described in detail.

Figure 2:
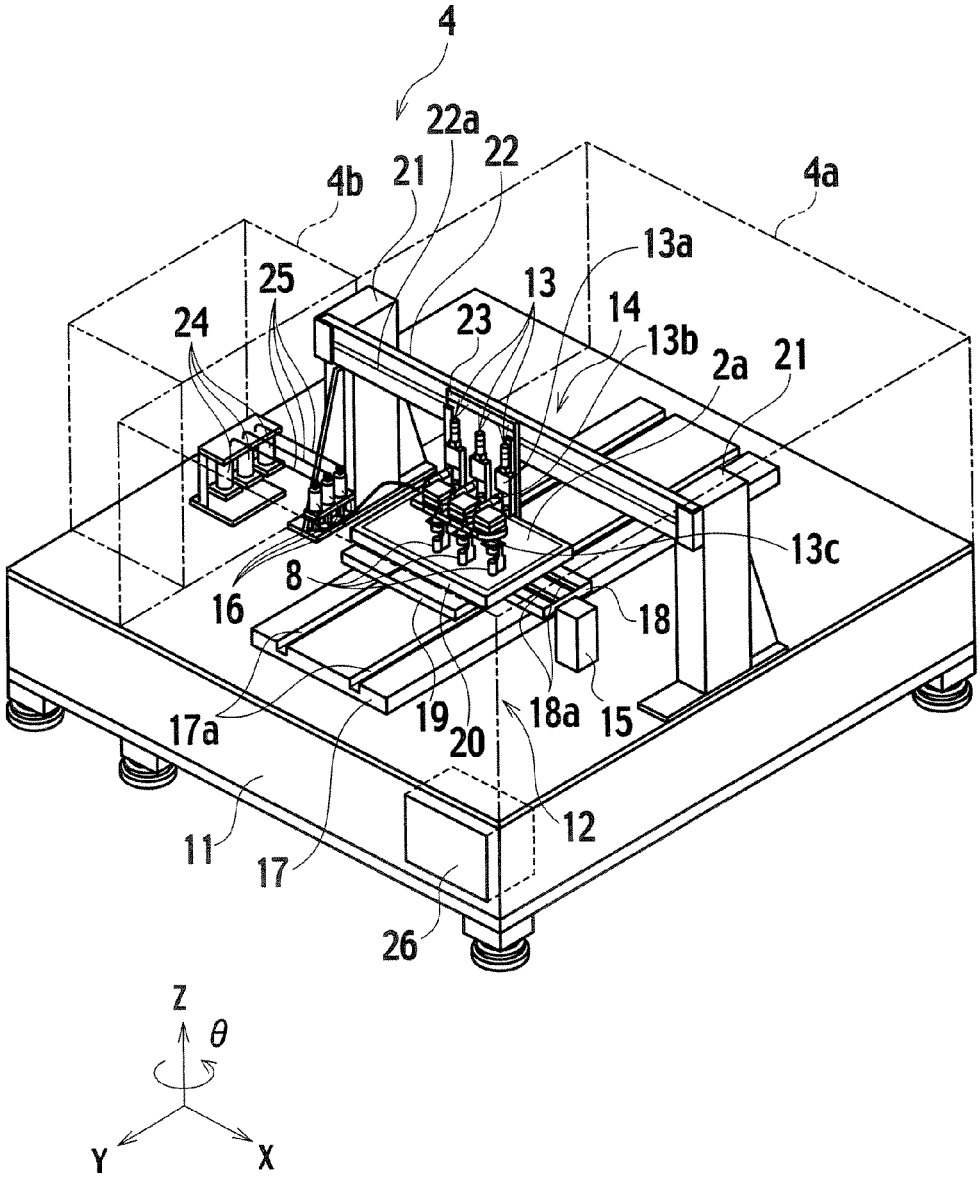
FIG. 2 is a perspective view illustrating a schematic structure of a coating unit provided in the droplet jetting applicator shown in FIG. 1.

As shown in FIG. 2, the coating unit 4 is structured so that an ink coating box 4*a* and an ink supply box 4*b* are provided so as to be adjacent to each other and so that both of the former and the latter are fixed to an upper surface of the counter 11.

The ink coating box 4*a* includes therein: a substrate moving mechanism 12 for retaining the substrate 2*a* to move the substrate 2*a* in an X axis direction and a Y axis direction; three ink jet head units 13 having droplet jetting heads 8, respectively; a unit moving mechanism 14 for moving the ink jet head units 13 in the X axis direction in an integrated manner; a head maintenance unit 15 for cleaning the respective droplet jetting heads 8; and three ink buffer tanks 16 for storing ink.

The substrate moving mechanism 12 is provided by layering a Y axis direction guide plate 17, a Y axis direction moving table 18, an X axis direction moving table 19, and a substrate retention table 20. These Y axis direction guide plate 17, Y axis direction moving table 18, X axis direction moving table 19, and substrate retention table 20 are shaped to have a flat plate-like shape, respectively.

The Y axis direction guide plate 17 is fixed to an upper surface of the counter 11. An upper surface of the Y axis direction guide plate 17 has a plurality of guide grooves 17*a* along the Y axis direction.

The Y axis direction moving table 18 has a plurality of projection sections (not shown) that are respectively engaged with the respective guide grooves 17*a* on a lower surface thereof and is provided at the upper surface of the guide plate 17 so that the Y axis direction moving table 18 is movable in the Y axis direction. An upper surface of the Y axis direction moving table 18 has a plurality of guide grooves 18*a* along the X axis direction. This Y axis direction moving table 18 is moved, by a feeding mechanism (not shown) using a feed screw and a driving motor, in the Y axis direction along the respective guide grooves 17*a*.

The X axis direction moving table 19 has projection sections (not shown) that are engaged with the respective guide grooves 18*a* on a lower surface thereof and is provided at the upper surface of the Y axis direction moving table 18 so as to be movable in the X axis direction. This X axis direction moving table 19 is moved, by a feeding mechanism (not shown) using a feed screw and a driving motor, in the X axis direction along the respective guide grooves 18*a*.

The substrate retention table 20 is fixed to the upper surface of the X axis direction moving table 19. This substrate retention table 20 includes an adsorption mechanism (not shown) for adsorbing the substrate 2*a* and uses the adsorption mechanism to fix and retain the substrate 2*a* at the upper surface. The adsorption mechanism may be, for example, an air adsorption mechanism. It is noted that the substrate retention table 20 is moved together with the X axis direction moving table 19 in the Y axis direction and can be moved to a coating position for subjecting the retained substrate 2*a* to an ink droplet coating (see FIG. 1 and FIG. 2) and a placement position at which the substrate 2*a* is placed on or removed from the substrate retention table 20.

The unit moving mechanism 14 has: a pair of support rods 21 standing from the upper surface of the counter 11; an X axis direction guide plate 22 provided between upper end sections of the support rods 21 to extend in the X axis direction; and a base plate 23 that is provided at the X axis direction guide plate 22 in the X axis direction in a movable manner and that supports the respective ink jet head units 13.

The pair of support rods 21 is provided so as to sandwich the Y axis direction guide plate 17 in the X axis direction. A front surface of the X axis direction guide plate 22 includes a guide groove 22*a* along the X axis direction.

A back surface of the base plate 23 has a projection section (not shown) that is engaged with the guide groove 22*a* so that the base plate 23 is provided at the X axis direction guide plate 22 so as to be movable in the X axis direction. This base plate 23 is moved, by a feeding mechanism (not shown) using a feed screw and a driving motor, along the guide groove 22*a* in the X axis direction. The base plate 23 as described above has a front surface attached with three ink jet head units 13.

The respective ink jet head units 13 are provided at the base plate 23 in the vertical direction and include the droplet jetting heads 8, respectively. These droplet jetting heads 8 are provided at tip ends of the respective ink jet head units 13 in a detachable manners respectively. The droplet jetting heads 8 have a plurality of nozzles for discharging droplets that jet droplets to the substrate 2*a*, respectively.

The ink jet head units 13 includes: a Z axis direction moving mechanism 13*a* for moving the droplet jetting heads 8 in a direction vertical to the surface of the substrate 2*a* (i.e., the Z axis direction); a Y axis direction moving mechanism 13*b* for moving the droplet jetting heads 8 in the Y axis direction; and a θ direction rotation mechanism 13*c* for rotating the droplet jetting heads 8 in the direction θ. This allows the droplet jetting heads 8 to move in the Z axis direction and the Y axis direction and to be rotated in the θ axis direction.

The head maintenance unit 15 is provided in an extended line of a direction along which the respective ink jet head units 13 are moved so that the head maintenance unit 15 is away from the Y axis direction guide plate 17. This head maintenance unit 15 cleans the droplet jetting heads 8 of the respective ink jet head units 13. It is noted that the head maintenance unit 15 automatically cleans the respective droplet jetting heads 8 when the droplet jetting heads 8 of the respective ink jet head units 13 are moved to a waiting position opposed to the head maintenance unit 15.

The ink buffer tanks 16 adjust ink fluid levels (meniscus) at the tip ends of the nozzles by using a water head difference (water head pressure) between fluid levels of ink stored therein and water heads at the nozzle surfaces of the droplet jetting heads 8. This prevents ink leakage or defective ink discharge.

The ink supply box 4*b* includes therein a plurality of ink tanks 24 for respectively storing ink that are attached in a detachable manner. The respective ink tanks 24 are connected to the droplet jetting heads 8 by supply pipes 25 via the ink buffer tanks 16, respectively. Specifically, the droplet jetting heads 8 are supplied with ink from the ink tanks 24 via the ink buffer tanks 16.

Ink may be various types of ink such as aqueous ink, solvent ink, or ultraviolet curing ink. For example, solvent ink is composed of various components such as pigment, solvent (ink solvent), dispersant, additive agent, and surface-active agent. Here, a frame of a color filter is formed by black ink. This frame is a light-shielding region provided around a penetration region (RGB region) through which light penetrates.

Solvent may be, for example, the one obtained by mixing PGMEA (propylene glycol monoethyl ether acetate), cyclohexanone, and BCTAC (butal carbitol acetate) with a ratio of 2:2:6. PGMEA and cyclohexanone are mixed with a vapor pressure of 500 Pa (20 degrees Celsius) and BCTAC is mixed with a vapor pressure of 1.3 Pa (20 degrees Celsius).

The counter 11 includes therein, for example, a control section 26 for controlling the respective parts of the droplet jetting applicator 1 and a memory section (not shown) for memorizing various programs. Based on various programs, the control section 26 performs, for example, a movement control of the Y axis direction moving table 18, a movement control of the X axis direction moving table 19, a movement control of the base plate 23, a control of the driving of the Z axis direction moving mechanism 13*a*, a control of the driving of the Y axis direction moving mechanism 13*b*, and a control of the driving of the θ direction rotation mechanism 13*c*. As a result, a relative position between the substrate 2*a* on the substrate retention table 20 and the droplet jetting heads 8 of the respective ink jet head units 13 can be changed in many ways. The control section 26 also performs, based on various programs, a control of the driving of the drying unit 5A and a control of the driving of the of the transport unit 7 for example.

Next, the drying unit 5A will be described in detail.

Figure 3:
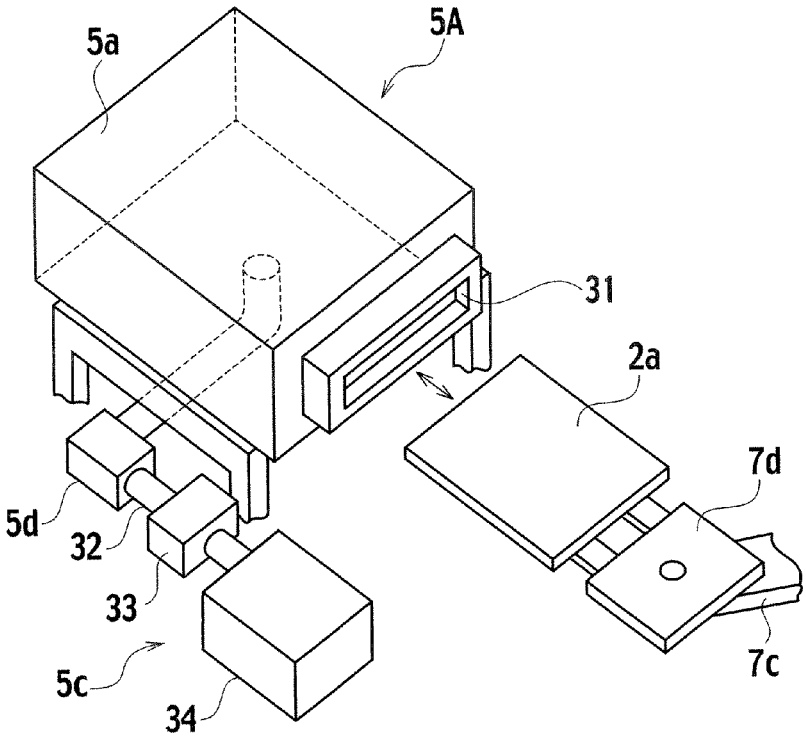
FIG. 3 is a perspective view illustrating a schematic structure of a drying unit provided in the droplet jetting applicator shown in FIG. 1.
Figure 4:
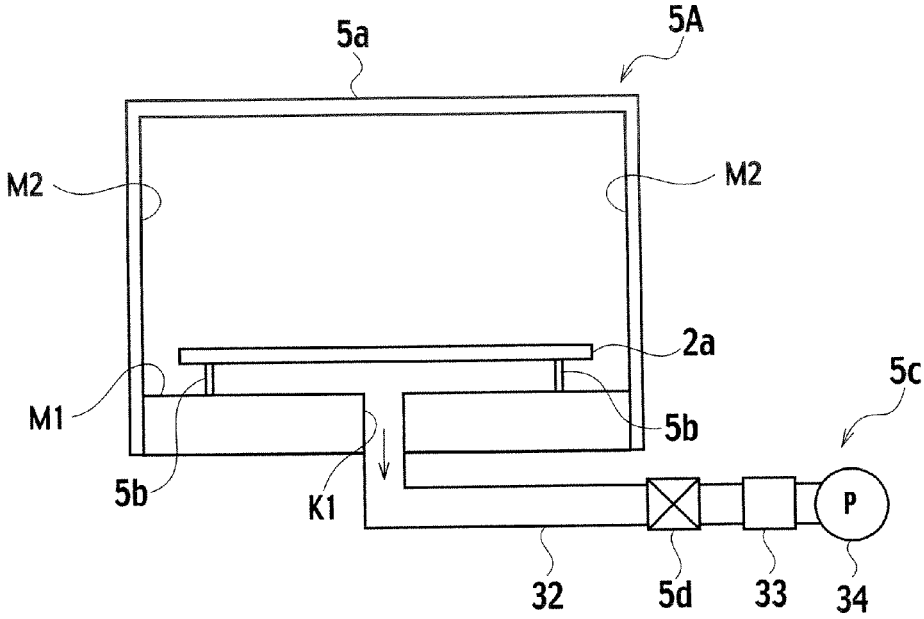
FIG. 4 is a schematic view illustrating a schematic structure of the drying unit shown in FIG. 3.

As shown in FIG. 3 and FIG. 4, the drying unit 5A includes: a storage space 5*a* for storing the coated substrate 2*a* (e.g., vacuum chamber); a plurality of support pins 5*b* (see FIG. 4) as a support section that are provided at a bottom surface M1 of the storage space 5*a* in a retractable manner and that support the substrate 2*a* at a protruded position; an exhaust section 5*c* for exhausting gas from underneath of the substrate 2*a* stored in the storage space 5*a*; and an adjustment unit 5*d* for adjusting an outlet flow ($m^3/s$) of gas exhausted from the storage space 5*a* by the exhaust section 5*c*.

The storage space 5*a* is shaped to have a box-like shape and has a door 31 (see FIG. 3) that can be opened or closed. Through this door 31, the coated substrate 2*a* is stored into the storage space 5*a*. The door 31 is opened to store the coated substrate 2*a* into the storage space 5*a* to subsequently close the door 31 in an airtight manner. After the drying operation, the door 31 is opened again and the coated body 2*b* as a dried substrate 2*a* is taken out. The storage space 5*a* has an opening section K1 provided at the bottom surface M1 thereof. It is noted that this opening section K1 is provided at a surface consisting of the bottom surface M1 of the storage space 5*a* and a side surface M2 closer to the bottom surface M1 than the surface of the stored substrate 2*a*.

The plurality of support pins 5*b* having a bar-like shape are provided at the bottom surface M1 of the storage space 5*a*. These support pins 5*b* are provided at the bottom surface M1 of the storage space 5*a* in a retractable manner and cooperate to support the substrate 2*a* at predetermined protruded positions (i.e., a position at which the substrate 2*a* is stored).

The exhaust section 5*c* has: an exhaust pipe 32 as an exhaust path connected to the opening section K1 of the bottom surface M1 of the storage space 5*a*; a vacuum tank 33 provided in the exhaust pipe 32; and an suction unit 34 for sucking gas in the storage space 5*a* via the exhaust pipe 32.

The exhaust pipe 32 is connected to the substantial center of the bottom surface M1 of the storage space 5*a*. The vacuum tank 33 is provided between the adjustment unit 5*d* and the suction unit 34. This vacuum tank 33 is sucked by the suction unit 34 until a predetermined vacuum pressure (e.g., 5 to 10 kPa) is reached to subsequently have a vacuum status. The suction unit 34 is connected, by the exhaust pipe 32, to the storage space 5*a* via the adjustment unit 5*d* and the vacuum tank 33. The suction unit 34 may be a suction pump for example. This suction unit 34 is drive-controlled by the control section 26 and sucks the gas in the storage space 5*a* via the exhaust pipe 32 to exhaust the gas.

The adjustment unit 5*d* is provided so as to be able to change the aperture ratio of the exhaust pipe 32. This adjustment unit 5*d* is drive-controlled by the control section 26 and changes the aperture ratio of the exhaust pipe 32. The adjustment unit 5*d* may be, for example, an on-off valve such as a butterfly valve or an electromagnetic valve.

The adjustment unit 5*d* changes the aperture ratio of the exhaust pipe 32 depending on the drive control by the control section 26 to change, in a stepwise manner, an outlet flow of the gas exhausted by the exhaust section 5*c* from the storage space 5*a* (stepwise release) so that gas in the storage space 5*a* is exhausted via the opening section K1 of the bottom surface M1 of the storage space 5*a*, thereby vacuumizing the storage space 5*a*. In this stepwise release, the control section 26 controls the adjustment unit 5*d* so that the outlet flow is changed in a stepwise manner, that is, the outlet flow is made smaller than the maximum outlet flow and, when the vacuum pressure in the storage space 5*a* reaches a predetermined vacuum pressure, the outlet flow is made to be the maximum outlet flow.

Figure 5:
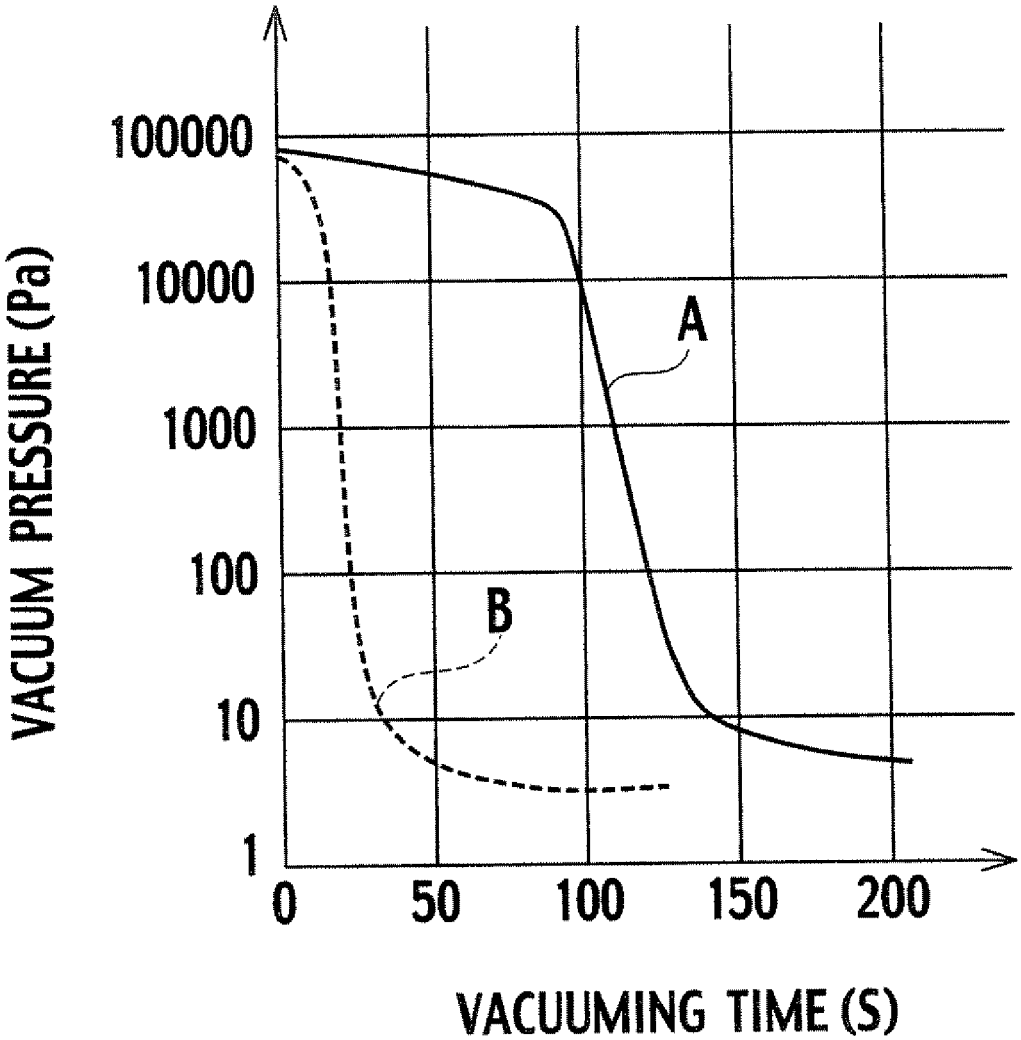
FIG. 5 is a diagram for explaining a relation between a vacuuming time and a vacuum pressure.

As a result, a vacuum profile such as a waveform A as shown in FIG. 5 is obtained for example. The waveform A is a waveform obtained when the aperture ratio of the exhaust pipe 32 is changed to change the outlet flow in a stepwise manner during the exhaust of the gas in the storage space 5*a*. It is noted that a waveform B is a waveform obtained when the gas in the storage space 5*a* is exhausted with a high speed and with a 100% aperture ratio of the exhaust pipe 32 and without changing the outlet flow (comparison example).

The adjustment unit 5*d* is drive-controlled by the control section 26 and adjusts the exhaust pipe 32 to have an aperture ratio of 40%. This provides the exhaust pipe 32 with an aperture ratio of 40% and the gas in the storage space 5*a* is exhausted with the first stage outlet flow (until a value close to 100 s in FIG. 5 is reached).

Next, the adjustment unit 5*d* is drive-controlled by the control section 26 and, when the vacuum pressure reaches 30 to 50 kPa for example (i.e., when about 100 s have passed since the vacuuming), the exhaust pipe 32 is adjusted to have a 100% aperture ratio (full open). As a result, the exhaust pipe 32 has a 100% aperture ratio and the gas in the storage space 5*a* is exhausted with the second stage outlet flow (after 100 s in FIG. 5). This second stage outlet flow is higher than the first stage outlet flow.

Next, the droplet jetting applicator 1 as described above will be described with regards to the droplet coating processing. The control section 26 of the droplet jetting applicator 1 performs the droplet jetting processing based on various programs.

Figure 6:
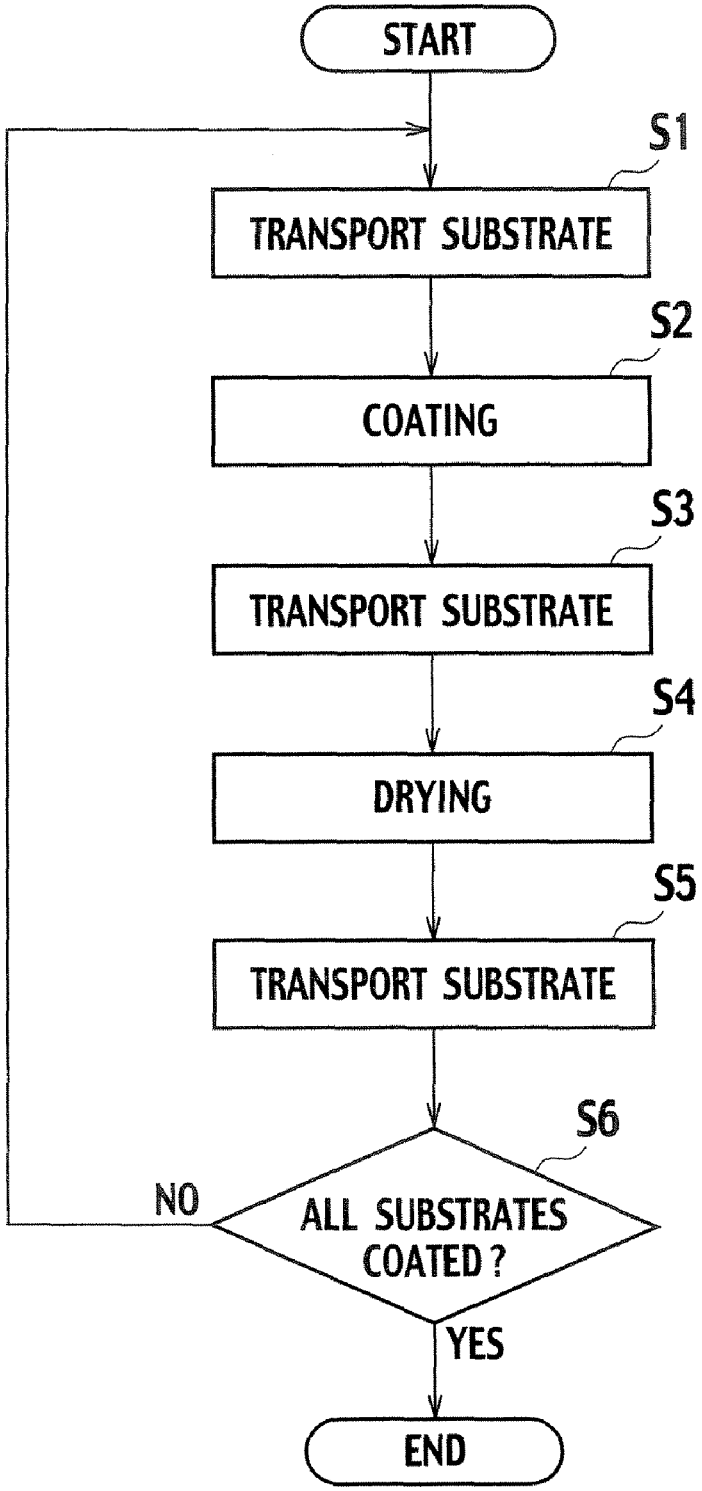
FIG. 6 is a flowchart illustrating the flow of a droplet coating processing of the droplet jetting applicator shown in FIG. 1.

As shown in FIG. 6, the control section 26 controls the driving of the transport unit 7 so that the substrate 2*a* is taken out from the storage rack 3*b* of the substrate storage section 3 and is transported to the coating unit 4 and the substrate 2*a* is placed on the substrate retention table 20 of the coating unit 4 (Step S1). This substrate 2*a* is retained on the substrate retention table 20 by the adsorption mechanism. It is noted that the substrate retention table 20 waits at the placement position at which the substrate 2*a* is placed.

Next, the control section 26 controls the driving of the coating unit 4 so that the substrate 2*a* on the substrate retention table 20 is coated with droplets (Step S2). In particular, the control section 26 controls the driving of the coating unit 4 so that the substrate retention table 20 is moved from the placement position to the coating position and the respective ink jet head units 13 are moved from the waiting position to a position facing the substrate 2*a*. Thereafter, the control section 26 controls the driving of the Y axis direction moving table 18 and the X axis direction moving table 19 and controls the driving of the droplet jetting heads 8 of the respective ink jet head units 13 so that the respective droplet jetting heads 8 jet droplets to the substrate 2*a* as a to-be-coated object.

As a result, nozzles of the respective droplet jetting heads 8 jet ink droplets and the droplets are adhered to the moving substrate 2*a*, thereby sequentially forming dot columns in a predetermined pattern. It is noted that, after the jetting operation, the control section 26 returns the respective ink jet head units 13 to the waiting position and moves the substrate retention table 20 from the coating position to the placement position.

Thereafter, the control section 26 controls the driving of the transport unit 7 so that the coated substrate 2*a* is taken out from the waiting substrate retention table 20 and is transported to the drying unit 5A and is placed in the storage space 5*a* of the drying unit 5A (Step S3). This substrate 2*a* is supported in the storage space 5*a* by the respective support pins 5*b*.

The control section 26 controls the driving of the drying unit 5A to dry the coated substrate 2*a* in the storage space 5*a* of the drying unit 5A (Step S4). In particular, the control section 26 controls the driving of the exhaust section 5*c* so that the vacuum tank 33 has therein a predetermined vacuum pressure (e.g., 5 to 10 kPa). Thereafter, the control section 26 controls the driving of the adjustment unit 5*d* so that the gas in the storage space 5*a* is exhausted through the opening section K1 of the bottom surface M1 of the storage space 5*a*, thereby vacuumizing the storage space 5*a*. Then, the control section 26 controls the adjustment unit 5*d* so that the outlet flow of the gas exhausted by the exhaust section 5*c* from the storage space 5*a* is changed in a stepwise manner, that is, the outlet flow is made smaller than the maximum outlet flow by causing the exhaust pipe 32 to have an aperture ratio of 40%. Then, when the storage space 5*a* has therein a predetermined vacuum pressure of 30 to 50 kPa for example, the control section 26 makes the exhaust pipe 32 to have a 100% aperture ratio and controls the driving of the adjustment unit 5*d* so that outlet flow is the maximum outlet flow. As a result, the vacuum pressure of the storage space 5*a* changes to draw the waveform A as shown in FIG. 5 and the storage space 5*a* is in a vacuum status, thereby completing the drying of the coated substrate 2*a*.

Thereafter, the control section 26 controls the driving of the transport unit 7 so that the coated body 2*b* as the dried substrate 2*a* is taken out from the storage space 5*a* of the drying unit 5A and is transported to the coated body storage section 6 and the substrate 2*a* is placed in the storage rack 6*b* of the coated body storage section 6 (Step S5).

Next, the control section 26 determines whether all substrates 2*a* stored in the substrate storage section 3 are subjected to an ink droplet coating or not (Step S6) by counting the number of the coated substrates 2*a* to determine whether the count value reaches a predetermined value or not. When it is determined that all substrates 2*a* are subjected to an ink droplet coating (Step S6: YES), then the processing is completed. When it is determined that all substrates 2*a* are not subjected to an ink droplet coating (Step S6: NO) on the other hand, the processing returns to Step S1 to repeat the above-described processings.

As described above, Embodiment 1 uses the adjustment unit 5*d* that adjusts an outlet flow of the gas exhausted from the storage space 5*a* by the exhaust section 5*c* and that is controlled so as to change the outlet flow in a stepwise manner. This can suppress the airflow from being generated in the storage space 5*a*. This can prevent a surface layer film generated on the surface of droplets (ink droplets) adhered to the substrate 2*a* from being formed. Thus, the coated body 2*b* can be prevented from being defectively manufactured by an explosion of the surface layer film.

Furthermore, the adjustment unit 5*d* is controlled so that the outlet flow is smaller than the maximum outlet flow and, when the vacuum pressure in the storage space 5*a* reaches a predetermined vacuum pressure, the outlet flow is made to be the maximum outlet flow. This can securely suppress airflow from being generated in the storage space 5*a*. This can securely suppress a surface layer film generated on the surface of droplets (ink droplets) adhered to the substrate 2*a* from being formed.

In addition, the storage space 5*a* has the opening section K1 that is provided at a surface consisting of the side surface M2 closer to the bottom surface M1 than the surface of the stored substrate 2*a* and the bottom surface M1. The exhaust section 5*c* exhausts the gas in the storage space 5*a* through the opening section K1. This can more securely suppress airflow from being generated in the storage space 5*a*. This can more securely suppress a surface layer film generated on the surface of droplets (ink droplets) adhered to the substrate 2*a* from being formed.

Embodiment 2

Hereinafter, Embodiment 2 of the present invention will be described with reference to FIG. 5 and FIG. 7.

Embodiment 2 of the present invention is basically the same as Embodiment 1. Embodiment 2 will be described with reference to the difference between Embodiment 2 and Embodiment 1. It is noted that the same components as those described for Embodiment 1 will be denoted with the same reference numerals and will not be described further.

Figure 7:
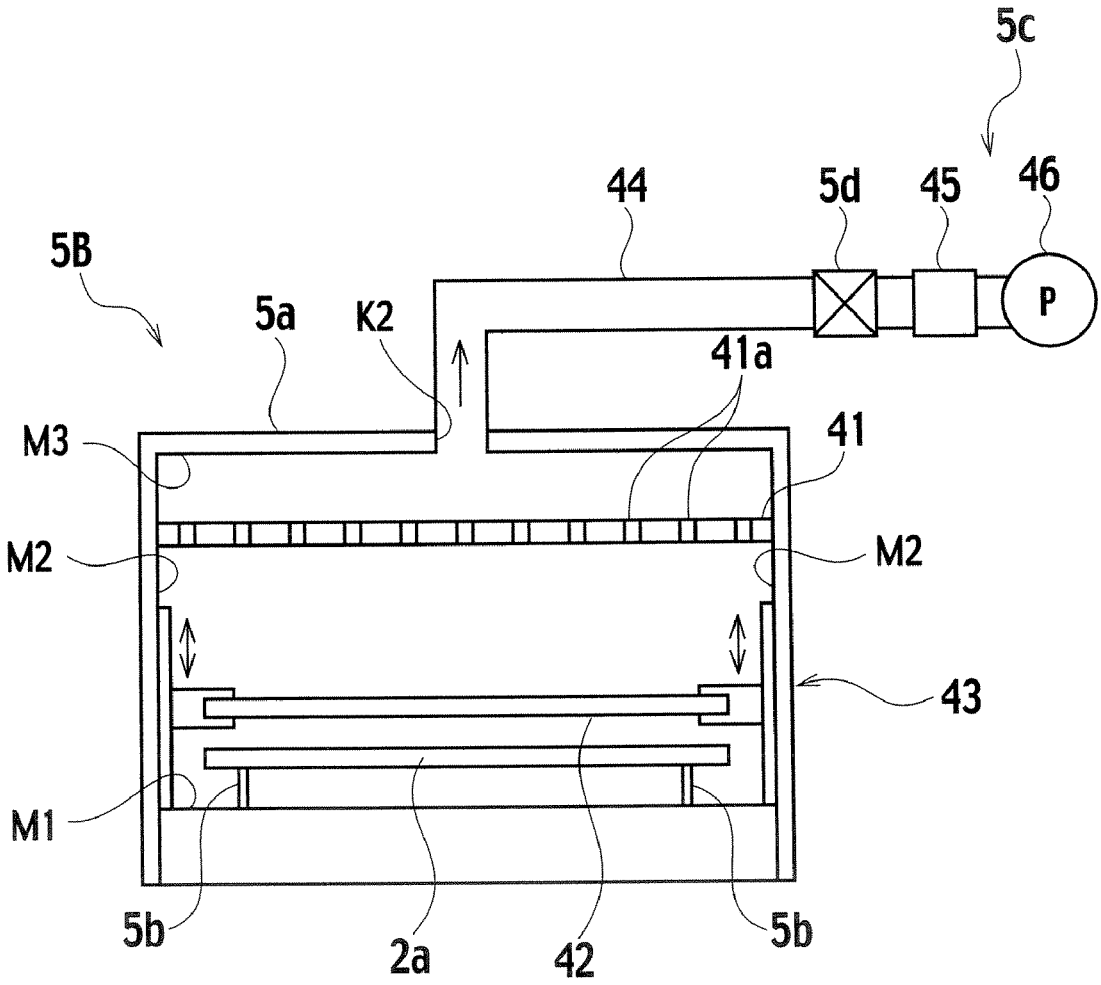
FIG. 7 is a schematic view illustrating the structure of a drying unit provided in a droplet jetting applicator according to Embodiment 2 of the present invention.

As shown in FIG. 7, a drying unit 5B includes: a storage space 5*a* for storing the coated substrate 2*a* (e.g., vacuum chamber); a plurality of support pins 5*b* that are provided, in a retractable manner, at the bottom surface M1 of the storage space 5*a* and that support the substrate 2*a* at the protruded position; an exhaust section 5*c* for exhausting the gas in the storage space 5*a* from above the substrate 2*a* stored in the storage space 5*a*; and an adjustment unit 5*d* for adjusting the outlet flow ($m^3/s$) of the gas exhausted from the storage space 5*a* by the exhaust section 5*c*.

The storage space 5*a* includes therein: a dispersion plate 41 that is positioned to have a distance from a storage position at which the coated substrate 2*a* is stored and that has a plurality of penetration holes 41*a*; a blocking plate 42 that is provided between the storage position and the dispersion plate 41 and that is provided so as to be able to have a contact with or be away from the storage position; and a moving section 43 that moves the blocking plate 42 in a direction along which the blocking plate 42 has a contact with or is away from the substrate 2*a* supported by the respective support pins 5*b*. The storage space 5*a* also has an opening section K2 that is provided at the top surface M3 thereof. It is noted that this opening section K2 is provided at a surface consisting of the top surface M3 of the storage space 5*a* and the side surface M2 closer to the top surface M3 than the surface of the dispersion plate 41.

The dispersion plate 41 divides the storage space 5*a* to an upper space and a lower space. This dispersion plate 41 includes the penetration holes 41*a* each having a square shape for example. The dispersion plate 41 may be a punching plate for example. The upper space of the storage space 5*a* is connected with the exhaust section 5*c* and the lower space stores therein the coated substrate 2*a*.

The blocking plate 42 is provided so as to be movable to the storage position of the coated substrate 2*a*, that is, so as to be movable in a space between the substrate 2*a* supported by the respective support pins 5*b* and the dispersion plate 41. The blocking plate 42 is also provided so as to have a contact with or be away from the substrate 2*a*. The blocking plate 42 may be a glass plate for example. It is noted that, when the exhaust section 5*c* performs an exhaust operation, the blocking 6 plate 42 is positioned at a position at which the blocking plate 42 is close to the substrate 2*a*. A distance between the blocking plate 42 and the substrate 2*a* (gap) is about 5 to 10 mm for example.

The moving section 43 supports the blocking plate 42 and moves the blocking plate 42 in a direction along which the blocking plate 42 has a contact with or is away from the substrate 2*a*. This allows the blocking plate 42 to be moved in an up-and-down direction between the storage position of the substrate 2*a* and the dispersion plate 41. This moving section 43 is drive-controlled by the control section 26. It is noted that, when the exhaust section 5*c* performs an exhaust operation, the moving section 43 moves the blocking plate 42 close to the substrate 2*a* so that a distance between the blocking plate 42 and the substrate 2*a* is about 5 to 10 mm for example. When a transport operation by the transport unit 7 is performed, the moving section 43 moves the blocking plate 42 away from the substrate 2*a* so as not to hinder the transport operation by the transport unit 7.

The exhaust section 5*c* has: an exhaust pipe 44 as an exhaust path connected to the opening section K2 of the top surface M3 of the storage space 5*a*; a vacuum tank 45 provided in the exhaust pipe 44; and a suction unit 46 that sucks, via the exhaust pipe 44, the gas in the storage space 5*a*.

The exhaust pipe 44 is connected to the substantial center of the top surface M3 of the storage space 5*a*. The vacuum tank 45 is provided between the adjustment unit 5*d* and the suction unit 46. This vacuum tank 45 is sucked by the suction unit 46 until a predetermined vacuum pressure of 5 to 10 kpa for example is reached and is made to have a vacuum status. The suction unit 46 is connected to the storage space 5*a* by the exhaust pipe 44 via the adjustment unit 5*d* and the vacuum tank 45. The suction unit 46 may be, for example, a suction pump. This suction unit 46 is drive-controlled by the control section 26 and sucks and exhausts the gas in the storage space 5*a* via the exhaust pipe 44.

The adjustment unit 5*d* is provided so as to be able to change an aperture ratio of the exhaust pipe 44. This adjustment unit 5*d* is drive-controlled by the control section 26 and changes the aperture ratio of the exhaust pipe 44. The adjustment unit 5*d* may be, for example, an on-off valve such as a butterfly valve or an electromagnetic valve.

The exhaust section 5*c* as described above causes, depending on the drive control by the control section 26, the aperture ratio of the exhaust pipe 44 to be 100% (full open) so that the outlet flow of the gas exhausted by the exhaust section 5*c* from the storage space 5*a* is the maximum outlet flow and the gas in the storage space 5*a* is exhausted with a high speed through the opening section K2 of the top surface M3 of the storage space 5*a* to allow the storage space 5*a* to have a vacuum status. Then, the control section 26 controls the driving of the adjustment unit 5*d* so that the outlet flow is the maximum outlet flow. This provides, for example, a vacuum profile like a waveform B as shown in FIG. 5.

The flow of the droplet coating processing by the droplet jetting applicator 1 of Embodiment 2 is the same as that of Embodiment 1 (see FIG. 6). In FIG. 6, Step S4 allows the control section 26 to control the driving of the drying unit 5B so that the coated substrate 2*a* in the storage space 5*a* of the drying unit 5B is dried (Step S4). In particular, the control section 26 firstly controls the driving of the moving section 43 so that the blocking plate 42 is moved closer to the substrate 2*a* until the distance between the substrate 2*a* stored in the storage position and the blocking plate 42 is about 5 to 10 mm for example. Thereafter, the control section 26 controls the driving of the exhaust section 5*c* so that the vacuum tank 45 has therein a predetermined vacuum pressure of 5 to 10 kPa for example. Thereafter, the adjustment unit 5*d* is drive-controlled so that the gas in the storage space 5*a* is exhausted through the opening section K2 of the top surface M3 of the storage space 5*a*, thereby allowing the storage space 5*a* to have therein a vacuum status. Then, the control section 26 controls the driving of the adjustment unit 5*d* so that the exhaust pipe 44 has a 100% aperture ratio to cause the outlet flow to be the maximum outlet flow. As a result, the vacuum pressure of the storage space 5*a* changes to draw the waveform B as shown in FIG. 5 and the storage space 5*a* has therein a vacuum status, thereby completing the drying of the coated substrate 2*a*.

As described above, according to Embodiment 2, the dispersion plate 41 having a plurality of penetration holes 41*a* is provided in the storage space 5*a* and the blocking plate 42 is provided below the dispersion plate 41 and the coated substrate 2*a* is provided below the blocking plate 42 so as to be in the vicinity of the blocking plate 42. In this structure, the gas in the storage space 5*a* can be exhausted from above the dispersion plate 41 to suppress airflow from being generated in the storage space 5*a*. This can suppress a surface layer film generated on the surface of droplets (ink droplets) adhered to the substrate 2*a* from being formed. This can prevent the coated body 2*b* from being defectively manufactured due to an explosion of the surface layer film.

Other Embodiments

It is noted that the present invention is not limited to the above-described embodiments and may be changed in various ways without departing from the contents.

For example, Embodiment 1 as described above controls the adjustment unit 5*d* so that the outlet flow is made smaller than the maximum outlet flow and, when the vacuum pressure in the storage space 5*a* reaches a predetermined vacuum pressure, the outlet flow is made to be the maximum outlet flow. However, the present invention is not limited to this. Another configuration also may be used, for example, in which the adjustment unit 5*d* is controlled so that, the outlet flow is repeatedly changed and, when the vacuum pressure in the storage space 5*a* reaches a predetermined vacuum pressure, the outlet flow is made to be the maximum outlet flow. In this case, the adjustment unit 5*d* repeatedly changes the aperture ratio of the exhaust pipe 32 to 100% (full open) and 0% (full close) to subsequently change the aperture ratio of the exhaust pipe 32 to 100% to provide the maximum outlet flow. Then, the control section 26 performs a pulse-width modulation (PWM) control for example and controls the adjustment unit 5*d* so that the aperture ratio of the exhaust pipe 32 is repeatedly changed to 100% and 0% so as to provide a desired outlet flow profile.

Although Embodiment 1 as described above has provided an outlet flow in two stages to exhaust the gas in the storage space 5*a*, the present invention is not limited to this. Thus, the outlet flow also may be provided in three or four stages for example to exhaust the gas in the storage space 5*a*. It is noted that an initial outlet flow is set to be smaller than other outlet flows.

Although Embodiment 1 as described above has used an on-off valve as the adjustment unit 5*d*, the present invention is not limited to this. For example, a double pump for example also may be used as the adjustment unit 5*d*.

Although Embodiment 1 as described above has connected the exhaust pipe 32 to the bottom surface M1 of the storage space 5*a*, the present invention is not limited to this. For example, the exhaust pipe 32 also may be connected to the side surface M2 closer to the bottom surface M1 than the surface of the stored substrate 2*a*. Although Embodiment 1 as described above has connected one exhaust pipe 32 to the storage space 5*a* so that the gas in the storage space 5*a* is exhausted by the suction unit 34 via the exhaust pipe 32, the present invention is not limited to this. For example, another configuration also may be used in which two exhaust pipes 32 are connected to the storage space 5*a* so that the gas in the storage space 5*a* is exhausted by the suction unit 34 via these exhaust pipes 32. In this configuration, the two exhaust pipes 32 are provided at such a position that prevents airflow from being generated, the airflow promoting the formation of a surface layer film generated on an ink surface.

Although Embodiment 2 as described above has connected the exhaust pipe 44 to the top surface M3 of the storage space 5*a*, the present invention is not limited to this. For example, another configuration also may be used in which the exhaust pipe 44 is connected to the side surface M2 closer to the top surface M3 than the surface of the dispersion plate 41. Although Embodiment 2 as described above has connected one exhaust pipe 44 to the storage space 5*a* so that the gas in the storage space 5*a* is exhausted by the suction unit 46 via the exhaust pipe 44, the present invention is not limited to this. For example, another configuration also may be used in which two exhaust pipes 44 are connected to the storage space 5*a* so that the gas in the storage space 5*a* is exhausted by the suction unit 46 via these exhaust pipes 44. In this configuration, the two exhaust pipes 44 are provided at such a position that prevents airflow from being generated, the airflow promoting the formation of a surface layer film generated on an ink surface.

What is claimed is:

1. A droplet jetting applicator, comprising:

a coating unit jetting and coating droplets to a to-be-coated object;

a drying unit for drying the to-be-coated object coated with the droplets, the drying unit comprising:

a storage space storing the to-be-coated object coated with the droplets;

an exhaust section exhausting gas in the storage space; and an adjustment unit adjusting an outlet flow of the gas exhausted by the exhaust section from the storage space; and a control section configured to control the adjustment unit so that the outlet flow is changed in a stepwise manner, the control section configured to control the adjustment unit so that the outlet flow is made smaller than the maximum outlet flow when the exhaust section starts to exhaust the gas in the storage space and the outlet flow is made to be the maximum outlet flow when a vacuum pressure in the storage space reaches a predetermined vacuum pressure to thereby dry the to-be-coated object coated with the droplets.

2. The droplet jetting applicator according to claim 1, wherein: the storage space has an opening section provided in a surface consisting of a side surface closer to a bottom surface than the surface of the stored to-be-coated object and the bottom surface;

the exhaust section exhausts gas in the storage space through the opening section.

3. A droplet jetting applicator comprising:

a coating unit jetting and coating droplets to a to-be-coated object;

a drying unit for drying the to-be-coated object coated with the droplets, the drying unit comprising:

a storage space storing the to-be-coated object coated with the droplets;

an exhaust section exhausting gas in the storage space; and an adjustment unit adjusting an outlet flow of the gas exhausted by the exhaust section from the storage space; and a control section configured to control the adjustment unit so that the outlet flow is changed in a stepwise manner, the control section configured to control the adjustment unit so that the outlet flow is repeatedly changed when the exhaust section starts to exhaust the gas in the storage space and the outlet flow is made to be the maximum outlet flow when a vacuum pressure in the storage space reaches a predetermined vacuum pressure to thereby dry the to-be-coated object coated with the droplets.

4. The droplet jetting applicator according to claim 3, wherein: the storage space has an opening section provided in a surface consisting of a side surface closer to a bottom surface than the surface of the stored to-be-coated object and the bottom surface;

the exhaust section exhausts gas in the storage space through the opening section.

* * * * *